US005479778A

United States Patent [19]

Toyooka et al.

[11] Patent Number: 5,479,778

[45] Date of Patent: Jan. 2, 1996

[54] HYDRAULIC CONTROL SYSTEM FOR CONSTRUCTION MACHINES

[75] Inventors: Tsukasa Toyooka, Ibaraki; Toichi Hirata, Ushiku; Genroku Sugiyama, Ibaraki; Akira Tatsumi, Tokyo, all of Japan

[73] Assignee: Hitachi Construction Machinery Co., Ltd., Tokyo, Japan

[21] Appl. No.: 352,807

[22] Filed: Dec. 1, 1994

[30] Foreign Application Priority Data

Dec. 2, 1993 [JP] Japan ..... 5-303019

[51] Int. Cl.[6] ..... F16D 31/02; F04B 49/00

[52] U.S. Cl. ..... 60/431; 60/468; 60/494; 417/34

[58] Field of Search ..... 60/431, 468, 494; 91/436, 420, 421; 417/34

[56] References Cited

U.S. PATENT DOCUMENTS

| | | | |
|---|---|---|---|
| 4,596,118 | 6/1986 | Heiser | 60/431 |
| 4,610,193 | 9/1986 | Barker et al. | 91/421 X |
| 4,685,295 | 8/1987 | Christiansen et al. | 91/421 X |
| 4,864,994 | 9/1989 | Myers | 60/431 X |
| 4,942,737 | 9/1990 | Tatsumi | 60/431 |
| 5,183,071 | 2/1993 | Ogawa | 91/436 X |
| 5,211,196 | 5/1993 | Schwelm | 91/420 X |
| 5,226,348 | 7/1993 | Dezelan et al. . | |
| 5,259,293 | 11/1993 | Brunner | 91/420 |

FOREIGN PATENT DOCUMENTS

| | | |
|---|---|---|
| 0262098 | 3/1988 | European Pat. Off. . |
| 0445703 | 9/1991 | European Pat. Off. . |
| 4-59484 | 9/1992 | Japan . |
| 2227295 | 7/1990 | United Kingdom . |

*Primary Examiner*—Edward K. Look
*Assistant Examiner*—Hoang Nguyen
*Attorney, Agent, or Firm*—Fay, Sharpe, Beall, Fagan, Minnich & McKee

[57] ABSTRACT

When the pump pressure detected through a pressure detecting line 48 is raised higher than a first predetermined pressure Pd1, a recovery switching valve 44 is shifted to a valve-closed position to cease the recovery function. At this time, the pump delivery pressure detected through a pressure detecting line 51 is higher than a second predetermined pressure Pd1* close to the first predetermined pressure Pd1, and an engine speed increasing device 52 controls an engine controller 11 to increase the rotational speed of an engine 10, thereby increasing the pump delivery rate. Thus, it is possible to make small speed change of an actuator and to increase working efficiency with no deterioration in operability, even when a recovery function is ceased.

14 Claims, 14 Drawing Sheets

RELATIONSHIP BETWEEN ia, ib AND PRESSURE IN SECOND EMBODIMENT

HYDRAULIC CONTROL SYSTEM FOR CONSTRUCTION MACHINES

BACKGROUND OF THE INVENTION

The present invention relates to a hydraulic control system mounted on construction machines such as hydraulic excavators and cranes, and more particularly to a hydraulic control system equipped with a recovery circuit for recovering a return fluid from a hydraulic actuator to the supply side when the pressure of a hydraulic fluid supplied to the actuator is small.

One of prior art hydraulic control systems equipped with recovery circuits is disclosed in JP, B, 4-59484, for example. This known hydraulic control system comprises a hydraulic pump, a hydraulic actuator, e.g., a hydraulic cylinder, driven by a hydraulic fluid delivered from the hydraulic pump, a directional control valve for controlling a flow of the hydraulic fluid supplied from the hydraulic pump to the hydraulic cylinder, and a recovery circuit for recovering a return fluid from the hydraulic cylinder to the supply side of the hydraulic cylinder when the pressure of the hydraulic fluid supplied to the hydraulic cylinder is small.

The recovery circuit comprises a recovery passage communicating between a drain passage and a supply passage in the directional control valve, a check valve provided in the recovery passage for allowing the hydraulic fluid to flow only in a direction from the drain passage to the supply passage, a recovery switching valve provided in the drain passage in the directional control valve, a pressure detecting passage for detecting a pressure in the supply passage in the directional control valve and transmitting the detected pressure to the recovery switching valve, and a pressure signal generator provided outside the directional control valve for generating a set pressure Pc for the recovery switching valve.

When the directional control valve is operated in a direction to extend the hydraulic cylinder, the hydraulic fluid delivered from the hydraulic pump flows through the supply passage in the directional control valve and then enters a bottom-side chamber of the hydraulic cylinder. The hydraulic fluid flowing out of a rod-side chamber of the hydraulic fluid is returned to a reservoir through the drain passage in the directional control valve. In addition, the pressure in the supply passage in the directional control valve is detected through the pressure detecting passage. When the detected pressure is lower than the set pressure Pc from the pressure signal generator, the drain passage is closed by the recovery switching valve in the directional control valve to effect a recovery function so that all of the return fluid from the rod-side chamber of the hydraulic cylinder is additively introduced to the supply passage through the recovery passage and the check valve in the directional control valve. When the load of the hydraulic cylinder is increased and the pressure in the supply passage is raised to such an extent that the detected pressure becomes higher than the set pressure Pc from the pressure signal generator, the drain passage closed by the recovery switching valve is now communicated with the reservoir. Therefore, the recovery function is ceased and the return fluid from the rod-side chamber of the hydraulic cylinder is returned to the reservoir without being introduced to the supply passage. In other words, when the load pressure generated upon the hydraulic cylinder being extended is lower than the set value, all of the return fluid from the rod-side chamber is recovered and introduced to the bottom-side chamber additively to increase the operating speed, but when the load pressure is increased, the hydraulic fluid is supplied only at the delivery rate of the hydraulic pump to the bottom-side chamber of the hydraulic cylinder.

SUMMARY OF THE INVENTION

In the prior art described above, when the load of the hydraulic cylinder is light and the pressure in the supply passage is lower than the set pressure Pc, the recovery function is effected and the flow rate of the hydraulic fluid supplied to the bottom-side chamber of the hydraulic cylinder is provided by the sum of the delivery rate of the hydraulic pump and the flow rate of the recovered fluid. Accordingly, the operating speed of the hydraulic cylinder is increased. On the other hand, when the load of the hydraulic cylinder is increased and the pressure in the supply passage becomes higher than the set pressure Pc, the recovery function is ceased and the hydraulic fluid is supplied only at the delivery rate of the hydraulic pump to the bottom-side chamber of the hydraulic cylinder. Therefore, the operating speed of the hydraulic cylinder under the heavy load is much slower than under the light load, resulting in that operability is deteriorated and working efficiency is reduced.

An object of the present invention is to provide a hydraulic control system for construction machines with which, even when a recovery function is ceased, speed change of an actuator is made small and working efficiency is increased with no deterioration in operability.

To achieve the above object, a hydraulic control system for construction machines according to the present invention is arranged as follows; the hydraulic control system for construction machines comprises an engine, engine control means for controlling a rotational speed of the engine, a hydraulic pump driven by the engine, a hydraulic actuator driven by a hydraulic fluid delivered from the hydraulic pump, a directional control valve for controlling a flow of the hydraulic fluid supplied from the hydraulic pump to the hydraulic actuator, and recovery means for recovering a return fluid from the hydraulic actuator to the supply side of the hydraulic actuator when the pressure of the hydraulic fluid supplied to the hydraulic actuator is smaller than a first predetermined value, the hydraulic control system further comprises detecting means for detecting the pressure of the hydraulic fluid supplied to the hydraulic actuator, and engine speed increasing means for controlling the engine control means to increase the rotational speed of the engine when the detected pressure is higher than a second predetermined pressure close to the first predetermined pressure.

When the load of the hydraulic actuator is light and the pressure of the hydraulic fluid supplied to the hydraulic actuator is lower than the first predetermined value, the return fluid from the hydraulic actuator is recovered and introduced to the supply side of the hydraulic actuator, and the flow rate of the hydraulic fluid supplied to the hydraulic actuator is provided by the sum of the delivery rate of the hydraulic pump and the flow rate of the recovered fluid. As a result, the operating speed of the hydraulic actuator is increased. When the load of the hydraulic actuator is increased and the pressure of the hydraulic fluid supplied to the hydraulic actuator becomes higher than the first predetermined value, the recovery function is ceased and the flow rate of the hydraulic fluid supplied to the hydraulic actuator is only equal to the delivery rate of the hydraulic pump. At this time, however, the pressure of the hydraulic fluid supplied to the hydraulic actuator is set to be higher than the second predetermined value, and the engine speed increasing means is operated to control the engine control means for increasing the engine speed. In response to an increase in the engine speed, the delivery rate of the hydraulic pump is increased to make small a reduction in speed of the hydraulic actuator.

In the above hydraulic control system, preferably, the detecting means is a pressure detecting line for introducing the pressure of the hydraulic fluid supplied to the hydraulic actuator to the engine speed increasing means, and the engine speed increasing means includes a hydraulic actuator operated with the pressure of the hydraulic fluid introduced through the pressure detecting line for controlling the engine control means.

More specifically, the detecting means is a pressure detecting line for introducing the pressure of the hydraulic fluid supplied to the hydraulic actuator to the engine speed increasing means, the engine control means includes a fuel injector provided with a governor lever, and the engine speed increasing means includes a hydraulic actuator connected to the pressure detecting line so that the pressure of the hydraulic fluid supplied to the earlier-said hydraulic actuator is introduced to the last-said hydraulic actuator through the pressure detecting line for operation thereof, lever means for moving the governor lever in a direction to increase the engine speed by operation of the last-said hydraulic actuator, and holding means for preventing the operation of the last-said hydraulic actuator until the introduced pressure reaches the second predetermined value.

Also in the above hydraulic control system, preferably, the detecting means is a pressure sensor for converting the pressure of the hydraulic fluid supplied to the hydraulic actuator into an electric signal, and the engine speed increasing means includes processing means for controlling the engine control means in accordance with the pressure detected by the pressure sensor.

More specifically, the detecting means is a pressure sensor for converting the pressure of the hydraulic fluid supplied to the hydraulic actuator into an electric signal, the engine control means includes first calculating means for calculating a first drive signal corresponding to the input amount of a control lever and a fuel injector for controlling the rotational speed of the engine in accordance with the first drive signal, and the engine speed increasing means includes second calculating means for calculating a second drive signal greater than the first drive signal and outputting the second drive signal instead of the first drive signal when the pressure detected by the pressure sensor is raised higher than the second predetermined value.

Preferably, the second calculating means includes means for calculating an incremental value of the drive signal when the pressure of the hydraulic fluid supplied to the hydraulic actuator is raised higher than the second predetermined value, and means for adding the incremental value of the drive signal to the first drive signal to determine the second drive signal.

Further in the above hydraulic control system, preferably, the recovery means includes manually operating means capable of optionally adjusting the first predetermined value.

More specifically, the recovery means comprises a recovery circuit including a recovery switching valve disposed in a hydraulic line through which a return fluid from the hydraulic actuator flows, urging means for moving the recovery switching valve to a recovery position when the pressure of the hydraulic fluid supplied to the hydraulic actuator is smaller than the first predetermined value, and pressure generating means for outputting a pilot pressure to the urging means, the pressure generating means including manually operating means capable of adjusting the pilot pressure to adjust the first predetermined value.

Also in the above hydraulic control system, preferably, the engine speed increasing means includes manually operating means capable of optionally adjusting the second predetermined value, More specifically, the detecting means is a pressure sensor for converting the pressure of the hydraulic fluid, that is supplied to the hydraulic actuator, into an electric signal, and the engine speed increasing means includes processing means for controlling the engine control means in accordance with the pressure detected by the pressure sensor, and manually operating means for acting on the processing means to adjust the second predetermined value.

Preferably, the second predetermined value is substantially equal to or slightly smaller than the first predetermined value.

DETAILED DESCRIPTION OF THE PREFERRED EMBODIMENTS

Hereinafter, embodiments of the present invention will be described with reference to the drawings. A first embodiment of the present invention will first be described with reference to FIGS. 1 to 6.

Figure 1:
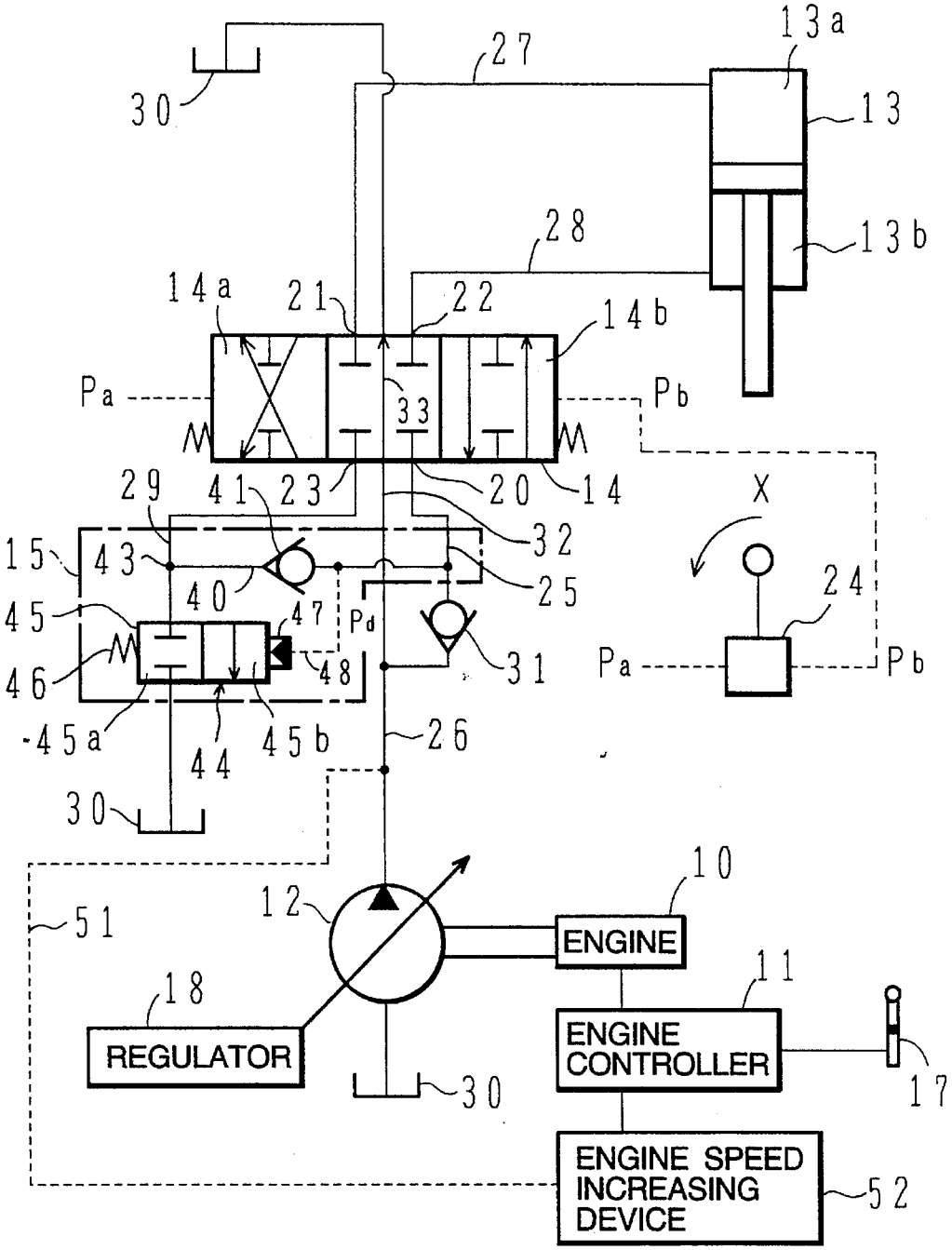
FIG. 1 is a diagram of a hydraulic control system for construction machines according to a first embodiment of the present invention.

In FIG. 1, a hydraulic control system of this embodiment comprises an engine 10, an engine controller 11 for controlling a rotational speed of the engine 10, a hydraulic pump 12 driven by the engine 10, a hydraulic cylinder 13 driven by a hydraulic fluid delivered from the hydraulic pump 12, a directional control valve 14 for controlling a flow of the hydraulic fluid supplied from the hydraulic pump 12 to the hydraulic cylinder 13, and a recovery circuit 15 for recovering a return fluid from the hydraulic cylinder 13 to the supply side of the hydraulic cylinder 13 when the pressure of the hydraulic fluid supplied to the hydraulic cylinder 13 (hereinafter referred to simply as the supply pressure) is smaller than a first predetermined value.

The engine 10 is a diesel engine, for example, and the engine controller 11 includes a fuel injector 16 (see FIG. 3) with an all speed governor for controlling the rotational speed of the engine 10 depending upon the input amount of an engine control lever 17.

The hydraulic pump 12 is of a variable displacement pump and its tilting amount, i.e., pump displacement, is controlled by a regulator 18. The regulator 18 may be of input torque limiting type and/or load sensing control type that are well known in the art. Alternatively, the hydraulic pump 12 may be of a fixed displacement pump.

The directional control valve 14 is of a center by-passing type which has a pump port 20, actuator ports 21, 22, and a reservoir port 23. The directional control valve 14 is shifted to one of positions 14*a*, 14*b* in response to a pilot pressure Pa, Pb from a pilot control lever unit 24. The pump port 20 of the directional control valve 14 is connected to a delivery line 26 of the hydraulic pump 12 through a fluid supply line 25, the actuator ports 21, 22 are connected respectively to a bottom-side chamber 13*a* and a rod-side chamber 13*b* of the hydraulic cylinder 13 through actuator lines 27, 28, and the reservoir port 23 is connected to a reservoir 30 through a reservoir line 29. A load check valve 31 for preventing the hydraulic fluid from flowing from the pump port 20 to the delivery line 26 reversely is disposed in the fluid supply line 25. The delivery line 26 of the hydraulic pump 12 is connected to the reservoir 30 through a center bypass line 32 and a center bypass passage 33 in the directional control valve 14.

The recovery circuit 15 includes a recovery line 40 communicating the reservoir line 29 and the fluid supply line 25 with each other, and a check valve 41 allowing the hydraulic fluid to flow only in a direction from the reservoir line 29 toward the fluid supply line 25. The recovery circuit 15 also includes a recovery switching valve 44 disposed downstream of a junction 43 where recovery line 40 is connected to the reservoir line 29. The recovery switching valve 44 comprises a spool 45 serving to form a variable throttle, a spring 46 acting on one end of the spool 45 to urge it toward a valve-closed position (i.e., a recovery position) 45*a*, and a pressure receiving sector 47 acting on the other end of the spool 45 to urge it toward a valve-open position (i.e., a non-recovery position) 45*b*. The pressure receiving sector 47 is connected through a first pressure detecting line 48 to the fluid supply line 25 at a point between the pump port 20 and the load check valve 31, so that the delivery pressure of the hydraulic pump 12, i.e., pump pressure Pd, as representing the supply pressure to the hydraulic cylinder 13 is introduced to the pressure receiving sector 47.

Figure 2:
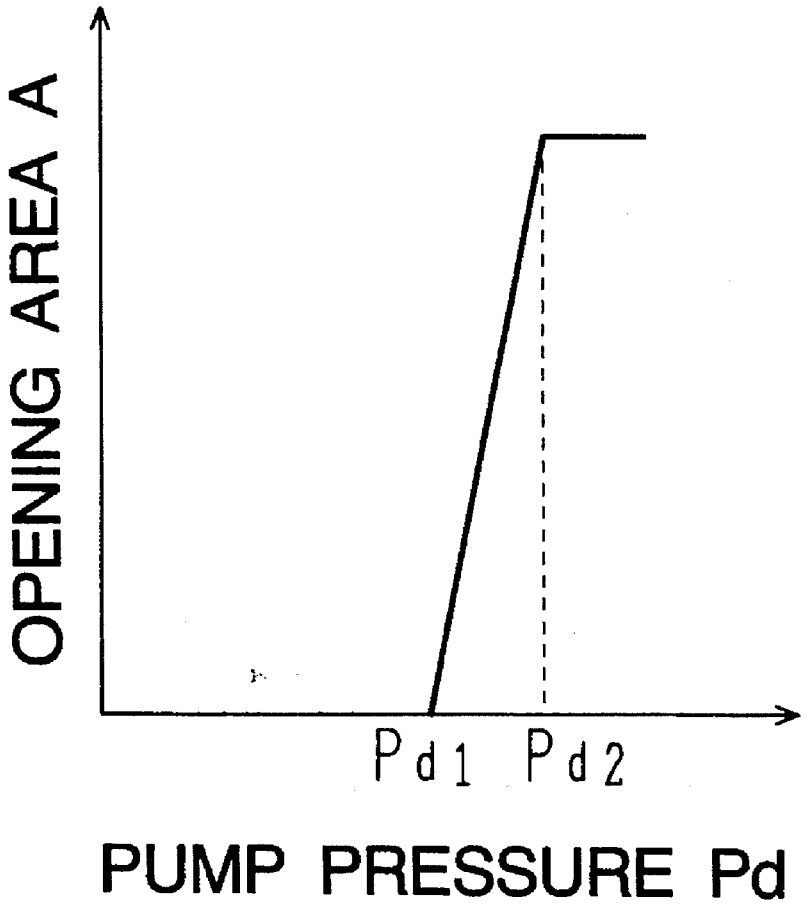
FIG. 2 is a graph showing an opening characteristic of a recovery switching valve shown in FIG. 1 with respect to a pump pressure.

FIG. 2 shows an opening characteristic of the recovery switching valve 44. In the graph of FIG. 2, the horizontal axis represents the pump pressure Pd introduced to the pressure receiving sector 47 with Pd1 corresponding to a first predetermined value, and the vertical axis represents an opening area A of the variable throttle formed by the spool 45. When the pump pressure (supply pressure) Pd is lower than the first predetermined value Pd1, the variable throttle is closed. When the pump pressure Pd becomes higher than the first predetermined value Pd1, the opening area A of the variable throttle is gradually increased and reaches a maximum value at a pressure Pd2. The first predetermined value Pd1 is set by the spring 46.

In addition to the above arrangement, the hydraulic control system of this embodiment further comprises a second pressure detecting line 51 for detecting the delivery pressure of the hydraulic pump 12, i.e., the pump pressure, as representing the supply pressure to the hydraulic cylinder 13, and an engine speed increasing device 52 for increasing the rotational speed of the engine 10 when the detected supply pressure is higher than a second predetermined value Pd1* close to the first predetermined value Pd1.

Figure 3:
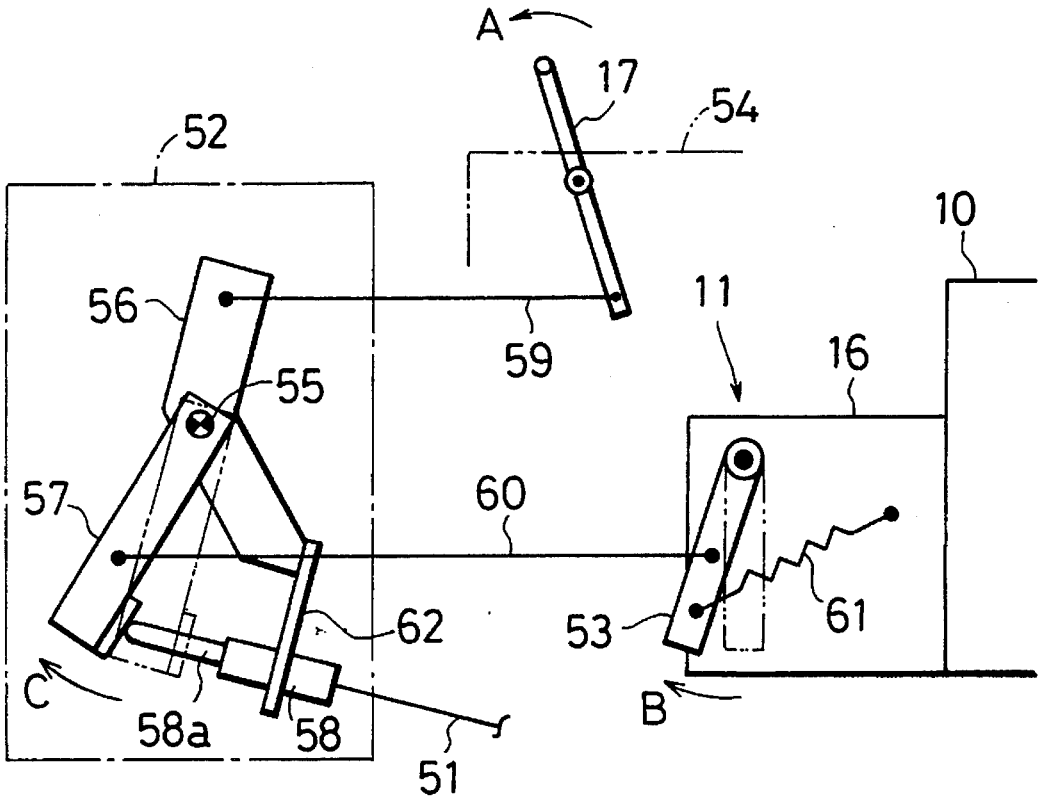
FIG. 3 is a view showing details of an engine controller and an engine speed increasing device shown in FIG. 1.

FIG. 3 shows details of the engine controller 11 and the engine speed increasing device 52. The engine controller 11 comprises the fuel injector 16 with an all speed governor as earlier described, and the fuel injector 16 includes a governor lever 53 as well known. The engine control lever 17 is turnably mounted in a console box 54 in a cab. The engine speed increasing device 52 comprises first and second levers 56, 57 and a hydraulic cylinder 58. The second pressure detecting line 51 is connected to the hydraulic cylinder 58. The first lever 56 is rotatably mounted at its central portion by a pin 55 to a frame integral with the console box 54, and has one end coupled to the engine control lever 17 through a push-pull cable 59. The second lever 57 has one end rotatably mounted by the pin 55 to the frame, and the other end coupled to the governor lever 53 through a push-pull cable 60. The governor lever 53 is associated with a tension spring 61 which normally urges the governor lever 53 and the second lever 57 to turn in the counterclockwise direction as viewed in FIG. 3. Here, the turning of the governor lever 53 and the second lever 57 in the counterclockwise direction corresponds to movement in a direction of increasing the rotational speed of the engine 10. Further, a bracket 62 is attached to the other end of the first lever 56, and the hydraulic cylinder 58 is mounted to the bracket 62. A piston rod 58*a* of the hydraulic cylinder 58 has its tip end held in abutment against an edge of the other end of the second lever 57 which is normally urged by the spring 61 to turn in the counterclockwise direction as mentioned above.

In the condition shown in FIG. 3, the engine control lever 17 is operated from its neutral position in the direction of arrow A, and the first lever is rotated from its neutral position to an illustrated solid-line position. At this time, if the pump pressure introduced to the hydraulic cylinder 58 is lower than the second predetermined value Pd1*, a torque applied from the hydraulic cylinder 58 to the second lever 57 in the clockwise direction is smaller than a torque applied from the spring 61 to the second lever 57 in the counterclockwise direction. Then, the second lever 57 is turned along with the first lever 56 and the hydraulic cylinder 58 in the clockwise direction to take a position indicated by two-dot-chain lines, and the governor lever 53 is also turned from its neutral position in the clockwise direction to take a position indicated by two-dot-chain lines. At this position of the governor lever 53, the engine 10 is controlled by the fuel injector 16 so that the engine speed is N1.

When the pump pressure is raised higher than the second predetermined value Pd1* from the above condition, the torque applied from the hydraulic cylinder 58 to the second lever 57 in the clockwise direction is now greater than the torque applied from the spring 61 to the second lever 57 in the counterclockwise direction. Therefore, the second lever 57 is further turned from the position indicated by two-dot-chain lines in the clockwise direction, i.e., in the direction of arrow C, with respect to the first lever 56 to thereby take a position indicated by solid lines. The governor lever 53 is also further turned from the position indicated by two-dot-chain lines in the clockwise direction, i.e., in the direction of arrow B, to thereby take a position indicated by solid lines. At this position of the governor lever 53, the engine 10 is controlled by the fuel injector 16 so that the engine speed is raised from N1 to N2. The second predetermined value Pd1* is set by the spring 61. Note that the second predetermined value Pd1* is set substantially equal to the first predetermined value Pd1 in this embodiment.

Figure 4:
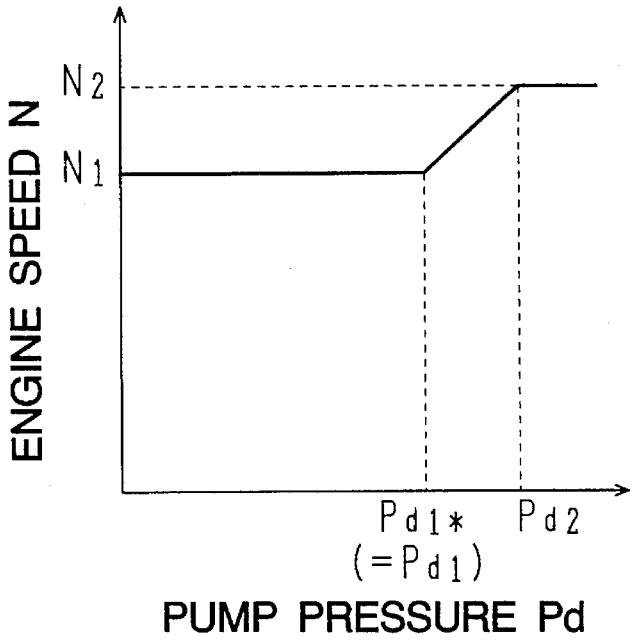
FIG. 4 is a graph showing an engine speed change characteristic of the engine speed increasing device shown in FIG. 1 with respect to the pump pressure.

FIG. 4 shows a characteristic of the engine speed increasing device 52. In FIG. 4, the horizontal axis represents the pump pressure Pd and the vertical axis represents the rotational speed N of the engine 10. When the pump pressure (supply pressure) is lower than the second predetermined value Pd1* (=Pd1), the engine speed is held constant at N1 set by the engine control lever 17. When the pump pressure becomes higher than the second predetermined value Pd1* (=Pd1), the engine speed is gradually increased and reaches a maximum value N2 at the pressure Pd2.

Figure 5:
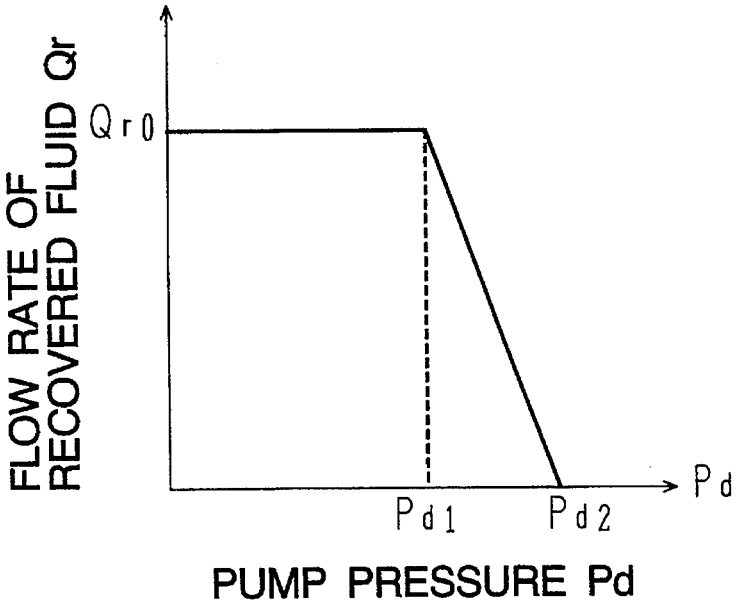
FIG. 5 is a graph showing a recovery characteristic of a recovery circuit shown in FIG. 1 with respect to the pump pressure.
Figure 6:
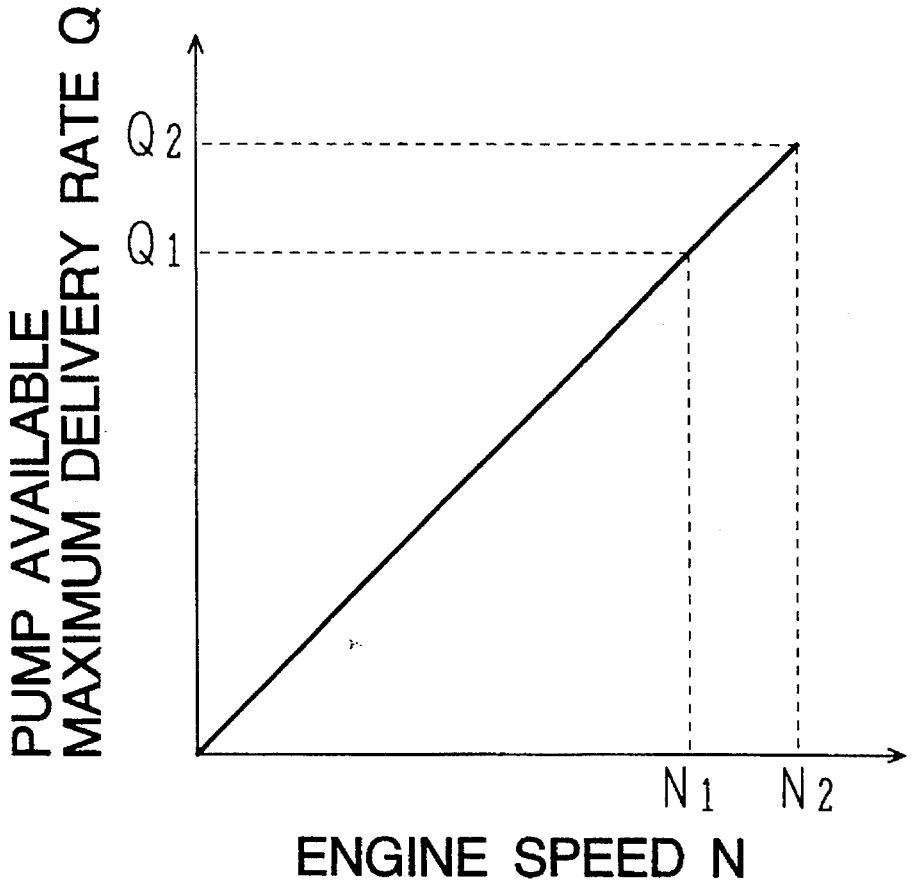
FIG. 6 is a graph showing a control characteristic of available maximum delivery rate of a hydraulic pump in the hydraulic control system shown in FIG. 1.

The operation of this embodiment arranged as above will be described below. When the pilot control lever unit 24 is operated in the direction of arrow X, the pilot pressure Pa is generated and the directional control valve 14 is shifted to the position 14a in response to the pilot pressure Pa. Therefore, the hydraulic fluid from the hydraulic pump 12 is supplied to the bottom-side chamber 13*a* of the hydraulic cylinder 13 through the fluid supply line 25 and the directional control valve 14, and the return fluid from the rod-side chamber 13*b* is returned to the reservoir 30 through the directional control valve 14 and the reservoir line 29. At this time, if the pump pressure Pd generated in the pressure supply line 25 and introduced to the first pressure detecting line 48 is lower than the value Pd1 set by the spring 46, i.e., the first predetermined value, the spool 45 of the recovery switching valve 44 is held at the valve-closed position (recovery position) 45*a* as shown in FIG. 2 to effect a recovery function. More specifically, the return fluid flowing out of the reservoir port 23 generates a recovery pressure in a portion of the reservoir line 29 between the reservoir port 23 and the recovery switching valve 44. When the generated recovery pressure becomes higher than the pump pressure Pd in the pressure supply line 25, part of the return fluid flowing out of the reservoir port 23 flows into the fluid supply line 25 through the recovery line 40 and the check valve 41, and is supplied to the pump port 20 after being joined to the hydraulic fluid from the hydraulic pump 12. FIG. 5 shows the recovery rate (flow rate of recovered fluid) produced at this time by Qro. As a result, the flow rate of the hydraulic fluid supplied to the bottom-side chamber 13*a* of the cylinder 13 is increased by an amount corresponding to the recovery rate Qro introduced from the reservoir line 29, and the moving speed of the cylinder 13 is increased accordingly. At this time, the rotational speed of the engine 10 is controlled by the engine controller 11 so as to have the constant value N1 shown in FIG. 4, and the available maximum delivery rate of the hydraulic pump 12 (i.e., the delivery rate resulted when the displacement of the hydraulic pump 12 is maximized) is provided by Q1 as shown in FIG. 6.

Then, if the pump pressure Pd is raised higher than the first predetermined value Pd1 to reach Pd2, for example, the pressure in the first pressure detecting line 48 becomes Pd2, whereupon the spool 45 of the recovery switching valve 44 is moved to the valve-open position (non-recovery position) 30*b* and the opening area A of the variable throttle is increased as shown in FIG. 2. Accordingly, the recovery function is ceased and the recovery rate Qr flowing from the reservoir line 29 into the fluid supply line 25 through the recovery line 40 and the check valve 41 is changed as shown in FIG. 5, eventually coming to zero. At this time, since the pump pressure Pd introduced to the engine speed increasing device 52 through the second pressure detecting line 51 also becomes Pd2 higher than the second predetermined value Pd1* (=Pd1), the hydraulic cylinder 58 of the engine speed increasing device 52 is driven as described above so that the rotational speed of the engine 10 is increased to N2 as shown in FIG. 4 and the available maximum delivery rate of the hydraulic pump 12 is increased from Q1 to Q2 as shown in FIG. 6. With such an increase in the pump delivery rate, the supply rate to the cylinder 13 becomes Q2 to make small speed change of the hydraulic cylinder 13 resulted from cease of the recovery function.

With this embodiment, therefore, even when the pump pressure Pd becomes higher than the first predetermined value Pd1 and the recovery function is ceased, the rotational speed of the engine 10 is increased to increase the pump delivery rate, thereby making small speed change of the hydraulic cylinder 13. As a result, working efficiency can be increased with no deterioration in operability.

While the second predetermined value Pd1* is set equal to the first predetermined value Pd1 in the above first embodiment, the second predetermined value Pd1* may be smaller or greater than the first predetermined value Pd1 so long as it is close thereto. Particularly, if the second predetermined value Pd1* is set to a value somewhat smaller than the first predetermined value Pd1 (i.e., Pd1*<Pd1), the control of raising the rotational speed of the engine 10 is started immediately before cease of the recovery function. Accordingly, the pump delivery rate can be increased without a delay after cease of the recovery function so as to make small speed change of the hydraulic cylinder 13.

Figure 7:
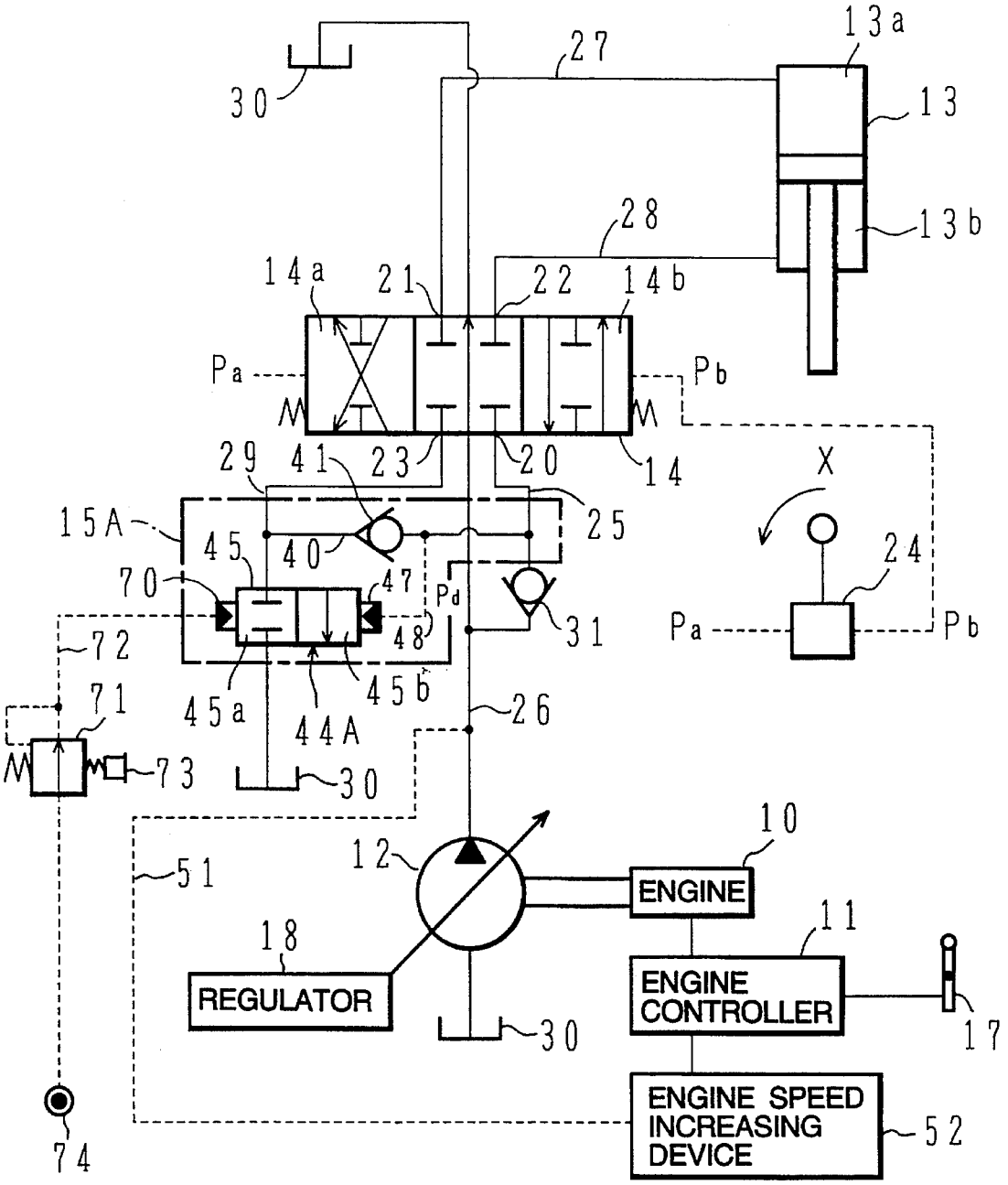
FIG. 7 is a diagram of a hydraulic control system for construction machines according to a second embodiment of the present invention.

A second embodiment of the present invention will be described with reference to FIG. 7. In FIG. 7, identical members to those in FIG. 1 are denoted by the same reference numerals. This embodiment is intended to make the first predetermined value Pd1 optionally adjustable from the outside.

Referring to FIG. 7, the hydraulic control system of this embodiment includes a recovery circuit 15A instead of the recovery circuit 15 shown in FIG. 1. The recovery circuit 15A includes a recovery switching valve 44A which has a pressure receiving sector 70 instead of the spring 46 shown in FIG. 1. The hydraulic control system of this embodiment also includes a pressure reducing valve 71 and a pressure line 72 for introducing a secondary pressure from the pressure reducing valve 71 to the pressure receiving sector 70. The pressure reducing valve 71 has a manually control unit 73. An operator can change the set value to vary the secondary pressure by operating the manually control unit 73. The secondary pressure introduced from the pressure reducing valve 71 to pressure receiving sector 70 acts on one end of the spool 45 to urge it toward the valve-closed position 45*a*, thereby setting the first predetermined value Pd1 in a hydraulic manner. Denoted by 74 is a pilot hydraulic source.

With this embodiment, since the set value of the pressure reducing valve 75 is changed to optionally adjust the first predetermined value Pd1 by operating the manually control unit 73, the relationship between the first predetermined value Pd1 and the second predetermined value Pd1* can be adjusted, as desired, to easily obtain the optimum relationship.

A third embodiment of the present invention will be described with reference to FIGS. 8 to 13. In these drawings, identical members to those in FIG. 1 are denoted by the same reference numerals. This embodiment is intended to control the recovery circuit and change in the engine speed in an electrohydraulic manner.

Figure 8:
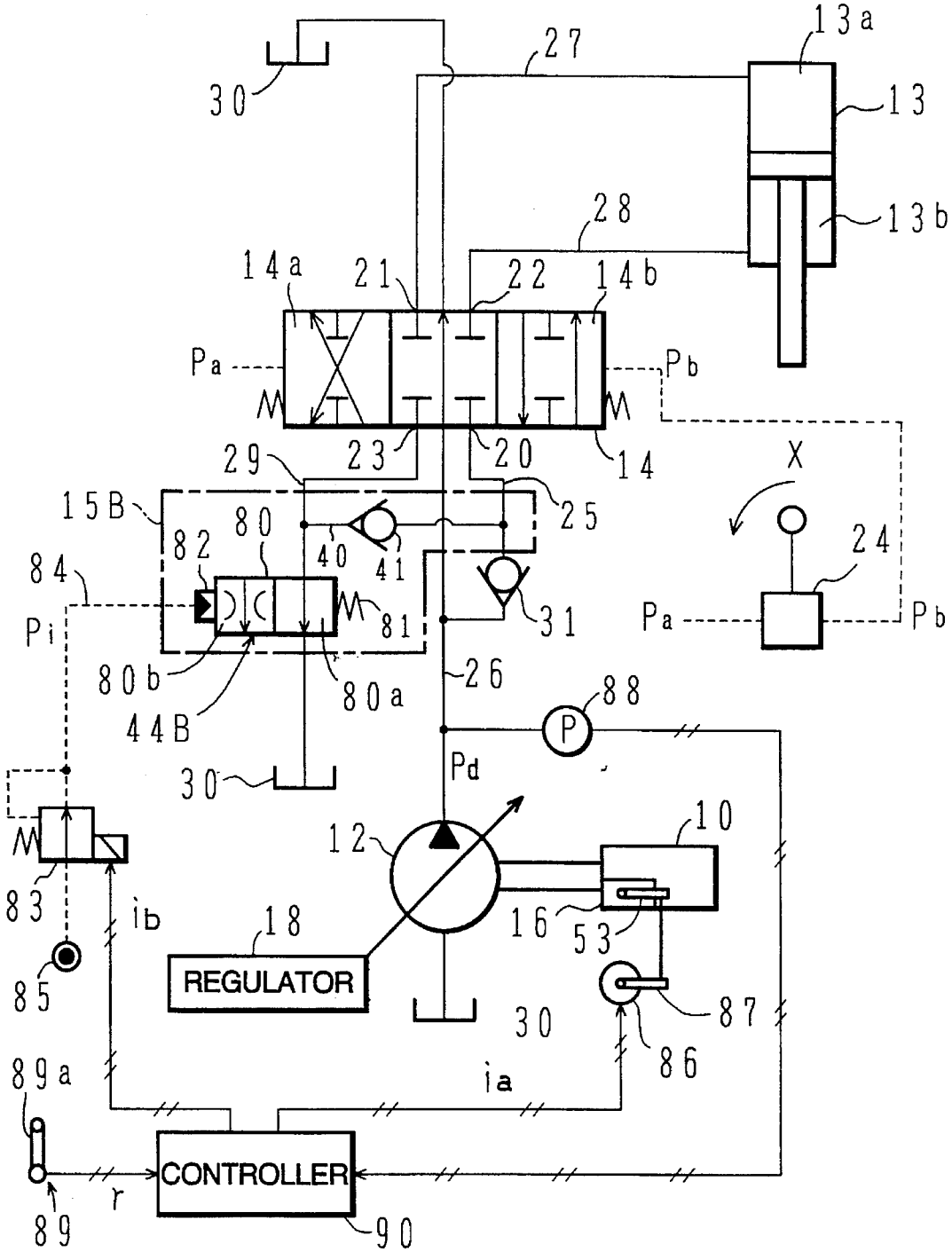
FIG. 8 is a diagram of a hydraulic control system for construction machines according to a third embodiment of the present invention.

Referring to FIG. 8, the hydraulic control system of this embodiment includes a recovery circuit 15B having a recovery switching valve 44B. The recovery switching valve 44B comprises a spool 80 serving to form a variable throttle, a spring 81 acting on one end of the spool 80 to urge it toward a valve-open position (i.e., a non-recovery position) 80*a*, and a pressure receiving sector 82 acting on the other end of the spool 80 to urge it toward a limit position (i.e., a recovery position) 80*b*. The pressure receiving sector 82 is connected to a solenoid proportional pressure reducing valve 83 through a pressure line 84, and a secondary pressure output from the solenoid proportional pressure reducing valve 83 is introduced as a pilot pressure Pi to the pressure receiving sector 82. Denoted by 85 is a pilot hydraulic source.

Further, the hydraulic control system of this embodiment comprises, as an engine controller, the fuel injector 16 with an all speed governor and the governor lever 53 similarly to the first embodiment, as well as a pulse motor 86 and a lever 87 for driving the governor lever 53. In addition, there are provided a pressure sensor 88 connected to the delivery line 26 of the hydraulic pump 12 for detecting the supply pressure, i.e., the pump pressure Pd, and outputting an electric signal, an engine control lever unit 89 for outputting an electric signal depending upon the input amount r of an engine control lever 89*a*, and a controller 90 for receiving both the electric signals output from the pressure sensor 88 and the engine control lever unit 89, and for calculating and outputting drive signals ia, ib to control the solenoid proportional pressure reducing valve 83 and the pulse motor 86, respectively.

Figure 9:
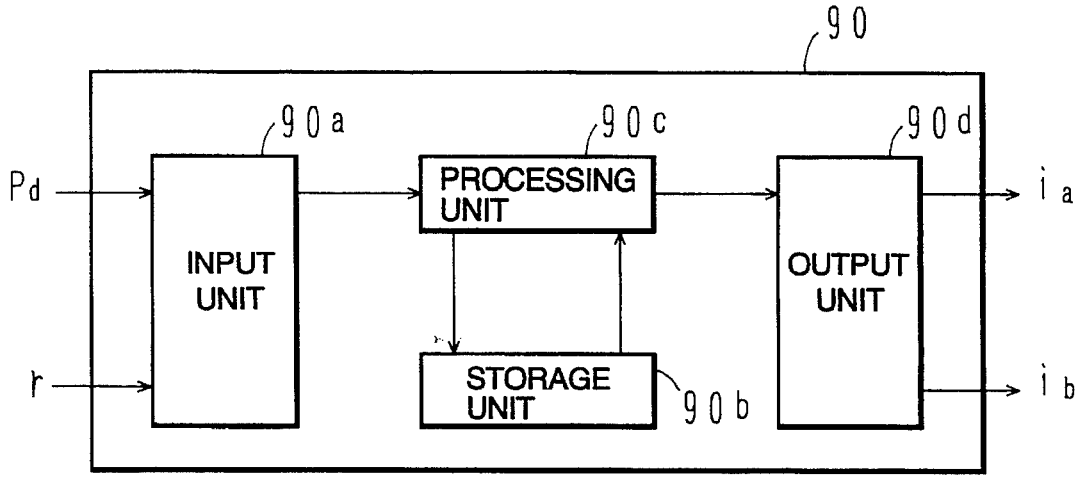
FIG. 9 is a diagram showing a hardware configuration of a controller shown in FIG. 8.

The controller 90 comprises, as shown in FIG. 9, an input unit 90*a* for receiving both the electric signals output from the pressure sensor 88 and the engine control lever unit 89 after A/D-converting them, a storage unit 90*b*, a processing unit 90*c* for calculating the drive signals ia, ib, and an output unit 90*d* for outputting the drive signals ia, ib after amplifying them.

Figure 10:
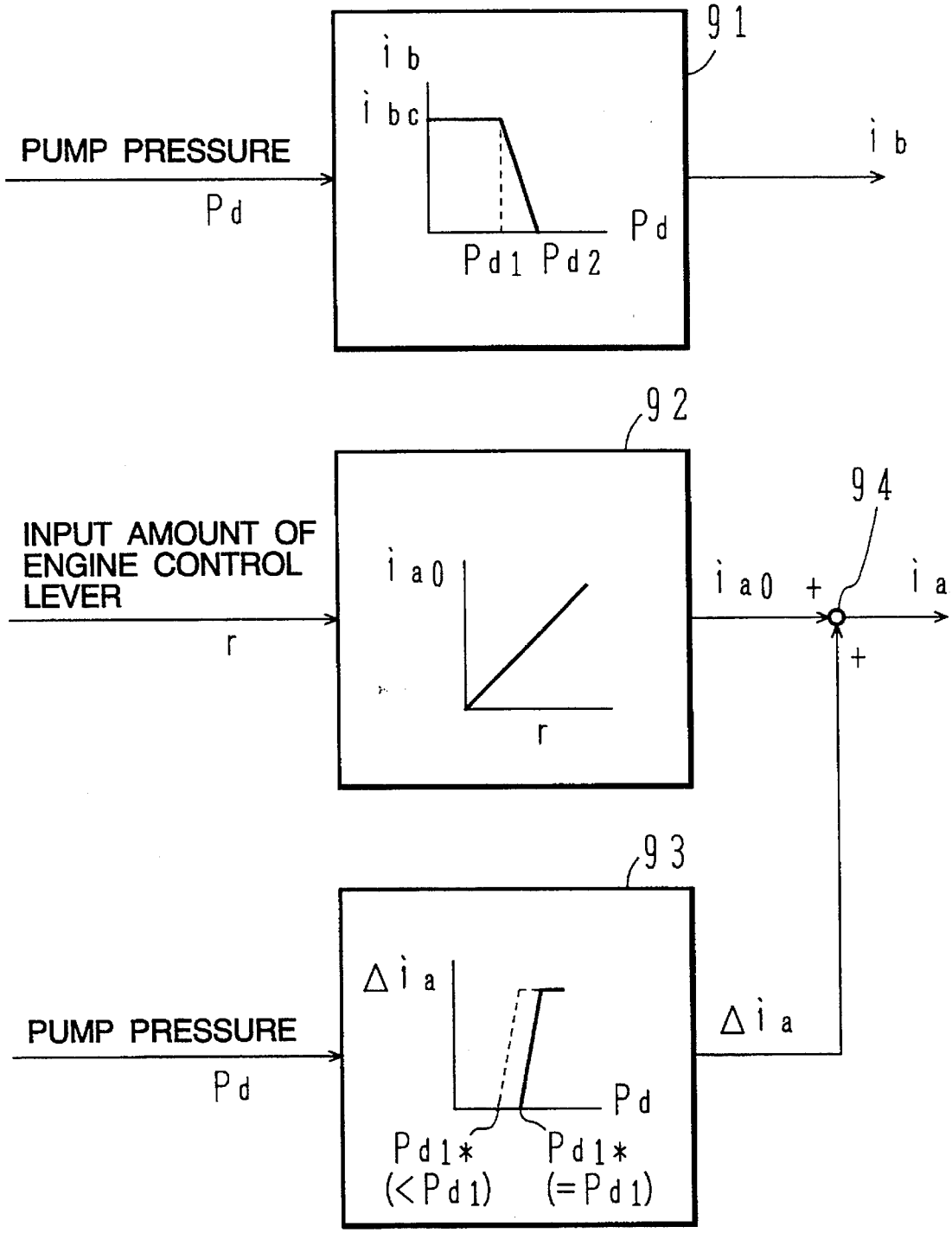
FIG. 10 is a functional block diagram showing processing procedures executed by the controller shown in FIG. 8.

The storage unit 90*b* of the controller 90 stores the relationship between the pump pressure Pd and the drive signal ib shown in a block 91 of FIG. 10, the relationship between the input amount r of the engine control lever 89*a* and the drive signal iao shown in a block 92, and the relationship between the pump pressure Pd and an incremental value Δia of the drive signal shown in a block 93.

The relationship between the pump pressure Pd and the drive signal ib shown in the block 91 is set such that when the pump pressure Pd is smaller than the first predetermined value Pd1, the drive signal ib is constant at ibc, but when the pump pressure becomes higher than the first predetermined value Pd, the drive signal ib is gradually reduced.

The relationship between the input amount r of the engine control lever 89*a* and the drive signal iao shown in the block 92 is set such that the drive signal iao is increased in proportion to the input amount r. The relationship between the pump pressure Pd and the incremental value Δia of the drive signal shown in the block 93 is set such that when the pump pressure Pd is smaller than the second predetermined value Pd1*, the incremental value Δia of the drive signal is zero, but when the pump pressure becomes higher than the second predetermined value Pd1*, it is increased from zero.

The processing unit 90*c* of the controller 90 calculates the drive signals ia, ib based on the above relationships. Specifically, the drive signal ib is calculated from the pump pressure Pd in the block 91. Further, the drive signal iao is calculated from the input amount r of the engine control lever in the block 92, and the incremental value Δia of the drive signal is calculated from the pump pressure Pd in the block 93. The drive signal iao and the incremental value Δia of the drive signal thus calculated are added in an adder 94 to obtain the drive signal ia.

Figure 11:
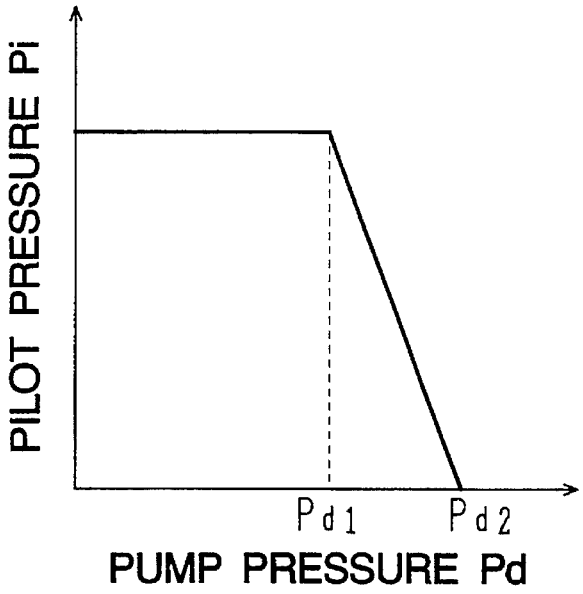
FIG. 11 is a graph showing an output characteristic of a solenoid proportional pressure reducing valve shown in FIG. 8 with respect to the pump pressure.

FIG. 11 shows the relationship between the pump pressure Pd and the pilot pressure Pi when the solenoid proportional pressure reducing valve 83 is driven by the drive signal ib. As seen from FIG. 11, the relationship between the pump pressure Pd and the pilot pressure Pi is almost the same as the relationship between the pump pressure Pd and the drive signal ib shown in the block 91 of FIG. 10. Thus, when the pump pressure (supply pressure) Pd is smaller than the first predetermined value Pd1, the pilot pressure Pi has a large constant value, but when the pump pressure becomes higher than the first predetermined value Pd1, the pilot pressure Pi is gradually lowered, eventually coming to zero at Pd2.

Figure 12:
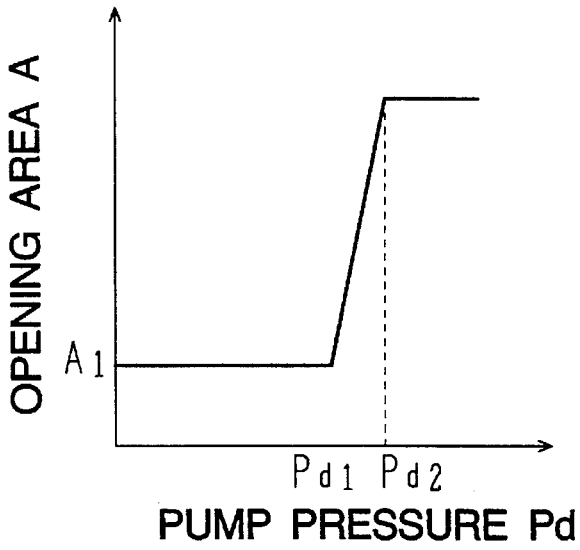
FIG. 12 is a graph showing an opening characteristic of a recovery switching valve shown in FIG. 8 with respect to the pump pressure.

FIG. 12 shows an opening characteristic of the recovery switching valve 44B driven by the pilot pressure Pi. As seen from FIG. 12, when the pump pressure (supply pressure) Pd is smaller than the first predetermined value Pd1, the opening area of the variable throttle is constant at a small value A1, but when the pump pressure becomes higher than the first predetermined value Pd1, the opening area A of the variable throttle is gradually increased and reach a maximum value at the pressure Pd2.

Figure 13:
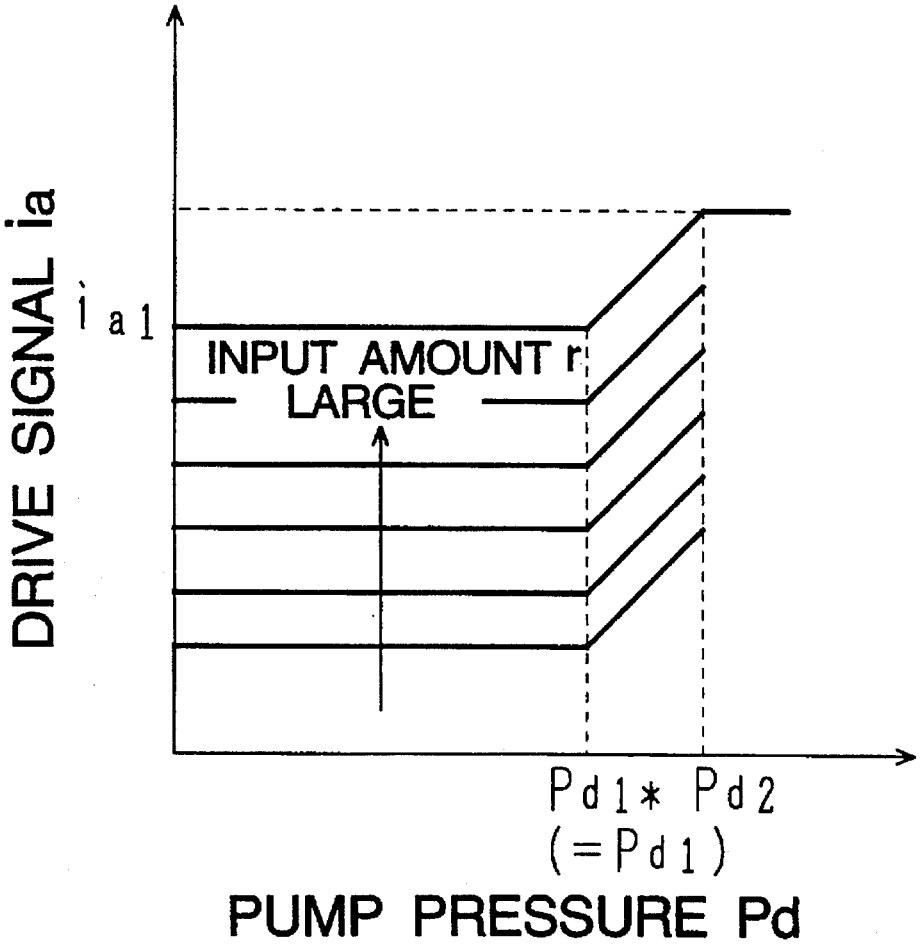
FIG. 13 is a graph showing a drive signal ia calculated by the controller shown in FIG. 8 in relation to the pump pressure Pd.

Further, the drive signal ia calculated as described above is related to the pump pressure Pd as shown in FIG. 13, and a characteristic resulted when the pulse motor 86 is driven by the drive signal ia is almost the same as that shown in FIG. 4 in connection with the first embodiment. Specifically, when the pump pressure (supply pressure) Pd is smaller than the second predetermined value Pd1* (=Pd1), the drive signal ia and the engine speed N are constant respectively at ia1 and N1 set by the engine control lever, but when the pump pressure becomes higher than the second predetermined value Pd1* (=Pd1), the drive signal ia and the engine speed N are gradually increased and reach maximum values at the pressure Pd2.

In the above arrangement, the block 92 in the controller 90, the pulse motor 86, the lever 87, the governor lever 53 and the fuel injector 16 make up the engine controller, while the block 93 in the controller 90 and the adder 94 make up the engine speed increasing device.

The operation of this embodiment arranged as above will be described below. When the control lever of the pilot control lever unit 24 is operated in the direction of arrow X, the pilot pressure Pa is generated and the directional control valve 14 is shifted to the position 14*a* in response to the pilot pressure Pa. Therefore, the hydraulic fluid from the hydraulic pump 12 is supplied to the bottom-side chamber 13*a* of the hydraulic cylinder 13 through the fluid supply line 25 and the directional control valve 14, and the return fluid from the rod-side chamber 13*b* is returned to the reservoir 30 through the directional control valve 14 and the reservoir line 29. At this time, when the pump pressure Pd detected by the pressure sensor 88 is lower than the first predetermined value Pd1, the high pilot pressure Pi is generated in response to the drive signal ib output from the controller 90 to the solenoid proportional pressure reducing valve 83 as shown in FIG. 11, and the spool 80 of the recovery switching valve 44B is held at the limit position (recovery position) 80*b* to effect a recovery function. More specifically, the return fluid flowing out of the reservoir port 23 generates a recovery pressure in a portion of the reservoir line 29 between the reservoir port 23 and the recovery switching valve 44. When the generated recovery pressure becomes higher than the pump pressure Pd in the pressure supply line 25, part of the return fluid flowing out of the reservoir port 23 flows into the fluid supply line 25 through the recovery line 40 and the check valve 41, and is supplied to the pump port 20 after being joined to the hydraulic fluid from the hydraulic pump 12. The recovery rate produced at this time is similar to Qro shown in FIG. 5 earlier referred to. As a result, the flow rate of the hydraulic fluid supplied to the bottom-side chamber 13*a* of the cylinder 13 is increased by an amount corresponding to the recovery rate Qro introduced from the reservoir line 29, and the moving speed of the cylinder 13 is increased accordingly. At this time, the drive signal ia output from the controller 90 to the pulse motor 86 has, e.g., a constant value ia1 shown in FIG. 13, the rotational speed of the engine 10 is controlled so as to have the constant value N1 shown in FIG. 4 earlier referred to, and the available maximum delivery rate of the hydraulic pump 12 is provided by Q1 as shown in FIG. 6 earlier referred to.

Then, if the pump pressure Pd is raised higher than the first predetermined value Pd1 to reach Pd2, for example, the pilot pressure Pi is reduced in response to the drive signal ib applied from the controller 90 to the solenoid proportional pressure reducing valve 83 as shown in FIG. 11, whereupon the spool 80 of the recovery switching valve 44B is moved to the valve-open position (non-recovery position) 80*a* and the opening area A of the variable throttle is increased as shown in FIG. 12. Accordingly, the recovery function is ceased and the recovery rate Qr flowing from the reservoir line 29 into the fluid supply line 25 through the recovery line 40 and the check valve 41 is changed as shown in FIG. 5 earlier referred to, eventually coming to zero. At this time, since the pump pressure Pd2 is also higher than the second predetermined value Pd1*, the controller 90 calculates the drive signal ia having a large value resulted from adding the drive signal iao and the incremental value Δia of the drive signal as shown in FIG. 13, the calculated drive signal ia being output to the pulse motor 86. Accordingly, the rotational speed of the engine 10 is increased to N2 as shown in FIG. 4 and the available maximum delivery rate of the hydraulic pump 12 is increased from Q1 to Q2 as shown in FIG. 6. With such an increase in the pump delivery rate, the supply rate to the cylinder 13 becomes Q2 to make small speed change of the hydraulic cylinder 13 resulted from cease of the recovery function.

With the third embodiment, therefore, even when the pump pressure Pd becomes higher than the first predetermined value Pd1 and the recovery function is ceased, the rotational speed of the engine 10 is increased to increase the pump delivery rate similarly to the above first embodiment, thereby making small speed change of the hydraulic cylinder 13. As a result, working efficiency can be increased with no deterioration in operability.

Also in this embodiment, the second predetermined value Pd1* for the supply pressure may be smaller or greater than the first predetermined value Pd1 so long as it is close thereto. The block 93 in FIG. 10 represents in a broken line the case where the second predetermined value Pd1* is set to a value somewhat smaller than the first predetermined value Pd1 (i.e., Pd1*<Pd1). In this case, as described above, since the control of raising the rotational speed of the engine 10 is started immediately before cease of the recovery function, the pump delivery rate can be increased without a delay after cease of the recovery function so as to make small speed change of the hydraulic cylinder 13. Further, since the first and second predetermined values are stored in the storage unit 90*b* in this embodiment, the relationship between the first and second predetermined values can be easily changed by rewriting the data in the storage unit 90*b*.

A fourth embodiment of the present invention will be described with reference to FIGS. 14 and 15. This embodiment is intended to make the second predetermined value Pd1* for the supply pressure, at which the engine speed is started to increase, optionally adjustable from the outside. In these drawings, identical members to those in FIGS. 1 and 8 are denoted by the same reference numerals.

Figure 14:
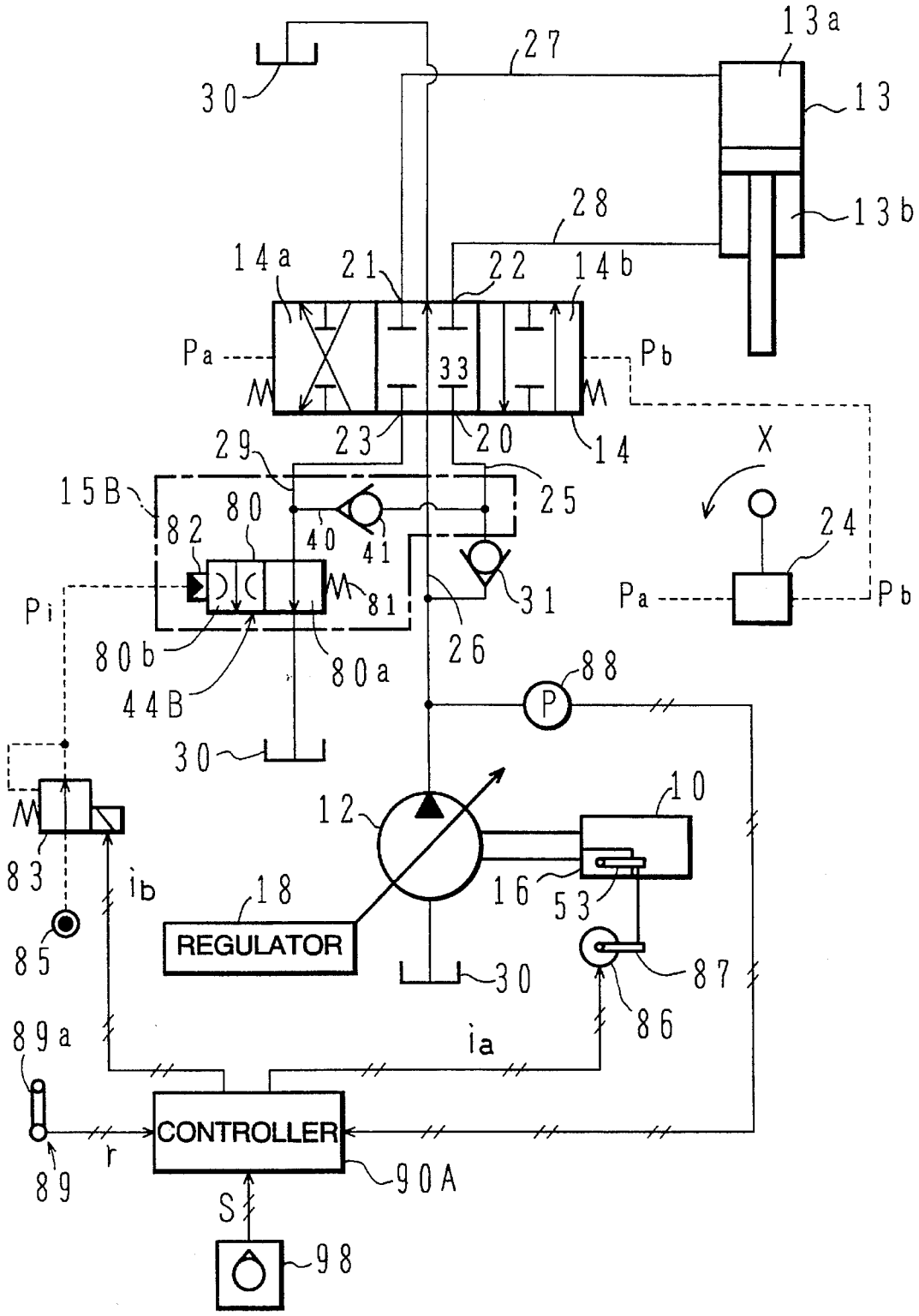
FIG. 14 is a diagram of a hydraulic control system for construction machines according to a fourth embodiment of the present invention.
Figure 15:
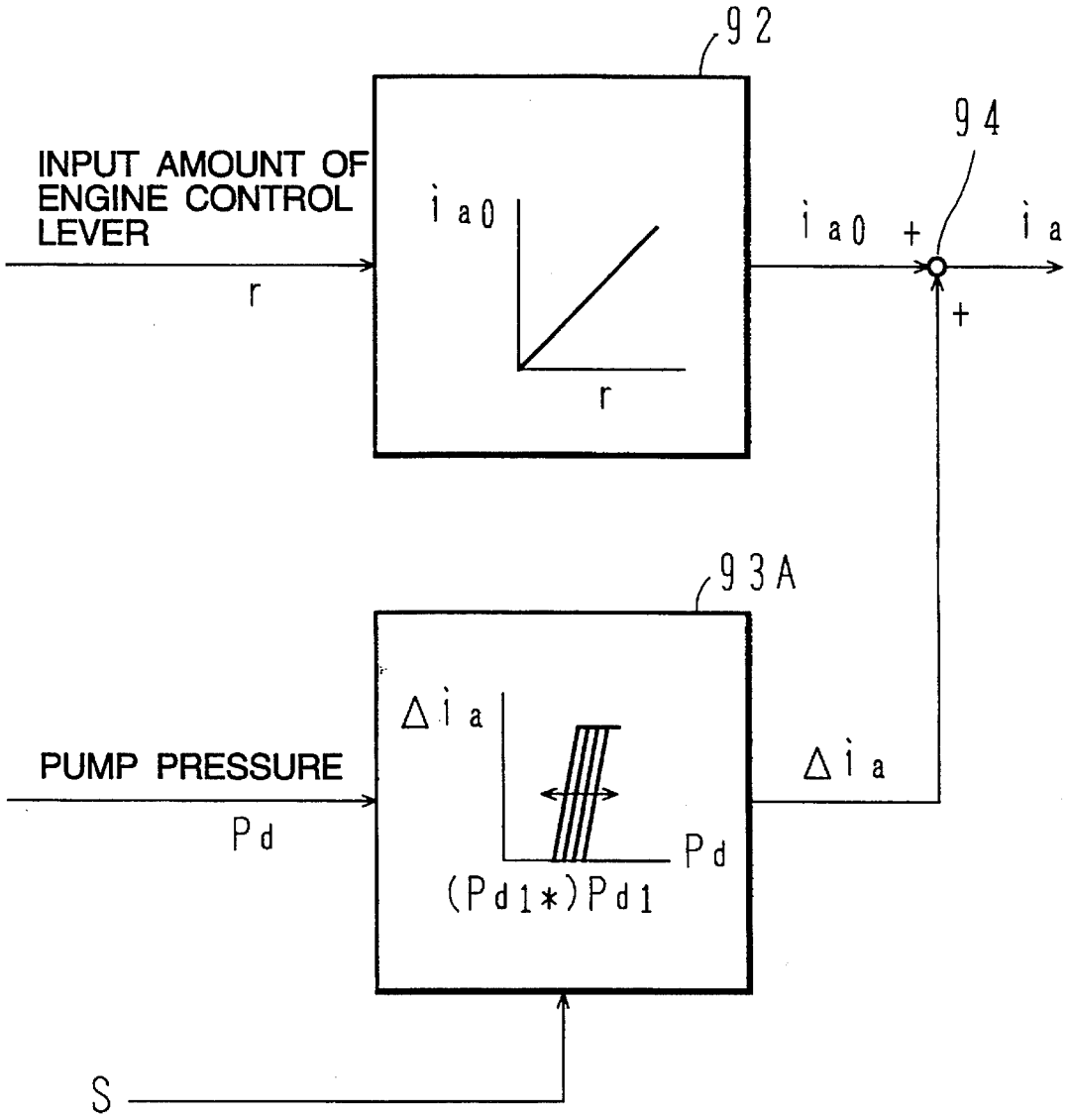
FIG. 15 is a functional block diagram showing processing procedures executed by a controller shown in FIG. 14.

Referring to FIG. 14, the hydraulic control system of this embodiment includes a variable volume 98 for setting the second predetermined value. A signal S from the variable volume 98 is applied to a controller 90A. In the controller 90A, as shown in FIG. 15, the relationship between the pump pressure Pd and the incremental value Δia of the drive signal stored in the block 93A is shifted parallel to the horizontal axis depending upon a level of the signal S, thereby changing the second predetermined value Pd1*.

With this embodiment, since the second predetermined value Pd1* for the supply pressure, at which the engine speed is started to increase, is optionally adjustable from the outside, the relationship between the first predetermined value Pd1 and the second predetermined value Pd1* can be adjusted, as desired, to easily obtain the optimum relationship.

A fifth embodiment of the present invention will be described with reference to FIG. 16. In this embodiment, the present invention is applied to a system in which the load pressure of the hydraulic actuator is employed as representing the supply pressure to hydraulic actuator.

Figure 16:
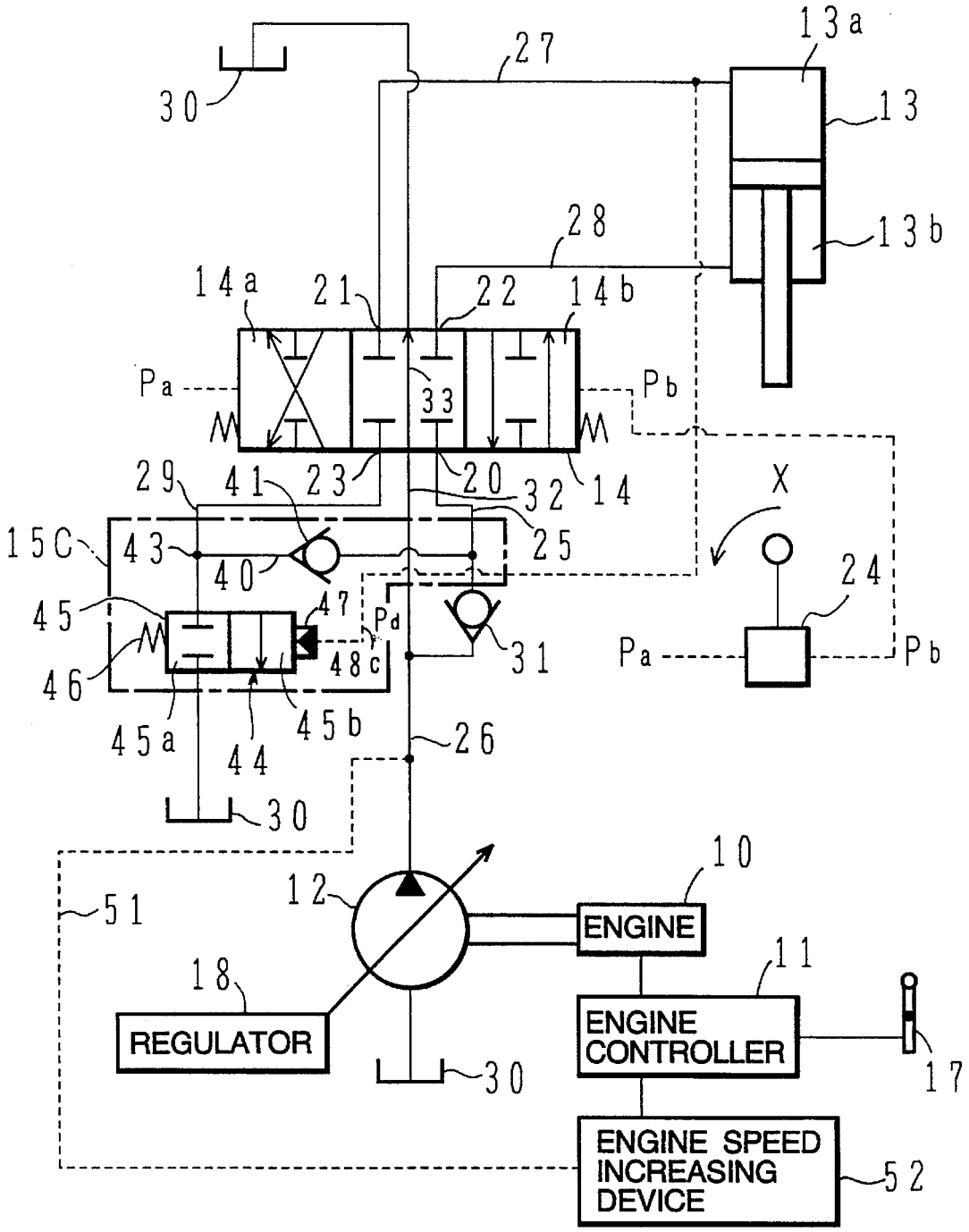
FIG. 16 is a diagram of a hydraulic control system for construction machines according to a fifth embodiment of the present invention.

Referring to FIG. 16, the hydraulic control system of this embodiment includes a recovery circuit 15C instead of the recovery circuit 15 shown in FIG. 1. The recovery circuit 15C includes a pressure detecting line 48C instead of the pressure detecting line 48 shown in FIG. 1. The pressure detecting line 48C is connected to the actuator line 27 so that the load pressure of the hydraulic cylinder 13 as representing the supply pressure to the hydraulic cylinder is supplied to the pressure receiving sector 47 of the recovery switching valve 44.

When the hydraulic cylinder 13 is driven with the delivery rate of the hydraulic pump 12, the delivery pressure of the hydraulic pump 12 is increased correspondingly as the load pressure is increased, and there is a certain relationship between both the pressures. Accordingly, the recovery switching valve 44 operates in the same manner as in the above first embodiment even with the load pressure of the hydraulic cylinder 13 used instead of the pump pressure.

In this embodiment, therefore, the engine speed increasing device 52 operates in combination with the recovery circuit 15C as with the above first embodiment, and hence can provide the similar advantages.

As apparent from the foregoing, according to the present invention, even when a recovery function is ceased due to an increase in load, the rotational speed of an engine is raised to increase the delivery rate of a hydraulic pump to make small speed change of an actuator. As a consequence, it is possible to prevent a deterioration in operability and to increase working efficiency.

What is claimed is:

1. A hydraulic control system for construction machines, comprising an engine, engine control means for controlling a rotational speed of said engine, a hydraulic pump driven by said engine, a hydraulic actuator driven by a hydraulic fluid delivered from said hydraulic pump, a directional control valve for controlling a flow of the hydraulic fluid supplied from said hydraulic pump to said hydraulic actuator, and recovery means for recovering a return fluid from the hydraulic actuator to the supply side of said hydraulic actuator when the pressure of the hydraulic fluid supplied to said hydraulic actuator is smaller than a first predetermined value, wherein said hydraulic control system further comprises:

detecting means for detecting the pressure of the hydraulic fluid supplied to said hydraulic actuator, and engine speed increasing means for controlling said engine control means to approximately simultaneously increase the rotational speed of said engine when the detected pressure is higher than said first predetermined pressure and a cessation of the recovering action of the recovery means is detected.

2. A hydraulic control system for construction machines according to claim 1, wherein said detecting means is a pressure detecting line for introducing the pressure of the hydraulic fluid supplied to said hydraulic actuator to said engine speed increasing means, and said engine speed increasing means includes a hydraulic actuator operated with the pressure of the hydraulic fluid introduced through said pressure detecting line for controlling said engine control means.

3. A hydraulic control system for construction machines according to claim 1, wherein said detecting means is a pressure detecting line for introducing the pressure of the hydraulic fluid supplied to said hydraulic actuator to said engine speed increasing means, said engine control means includes a fuel injector provided with a governor lever, and said engine speed increasing means includes a hydraulic actuator connected to said pressure detecting line so that the pressure of the hydraulic fluid supplied to earlier-said hydraulic actuator is introduced to last-said hydraulic actuator through said pressure detecting line for operation thereof, lever means for moving said governor lever in a direction to increase the engine speed by operation of last-said hydraulic actuator, and holding means for preventing operation of last-said hydraulic actuator until said introduced pressure reaches a second predetermined value close to said first predetermined value.

4. A hydraulic control system for construction machines according to claim 1, wherein said detecting means is a pressure sensor for converting the pressure of the hydraulic fluid supplied to said hydraulic actuator into an electric signal, and said engine speed increasing means includes processing means for controlling said engine control means in accordance with the pressure detected by said pressure sensor.

5. A hydraulic control system for construction machines according to claim 1, wherein said detecting means is a pressure sensor for converting the pressure of the hydraulic fluid supplied to said hydraulic actuator into an electric signal, said engine control means includes first calculating means for calculating a first drive signal corresponding to the input amount of a control lever and a fuel injector for controlling the rotational speed of said engine in accordance with said first drive signal, and said engine speed increasing means includes second calculating means for calculating a second drive signal greater than said first drive signal and outputting said second drive signal instead of said first drive signal when the pressure detected by said pressure sensor is raised higher than a second predetermined value close to said first predetermined value.

6. A hydraulic control system for construction machines according to claim 5, wherein said second calculating means includes means for calculating an incremental value of the drive signal when the pressure of the hydraulic fluid supplied to said hydraulic actuator is raised higher than said second predetermined value, and means for adding said incremental value of the drive signal to said first drive signal to determine said second drive signal.

7. A hydraulic control system for construction machines according to claim 1, wherein said recovery means includes manually operating means capable of optionally adjusting said first predetermined value.

8. A hydraulic control system for construction machines according to claim 1, wherein said recovery means comprises a recovery circuit including a recovery switching valve disposed in a hydraulic line through which a return fluid from said hydraulic actuator flows, urging means for moving said recovery switching valve to a recovery position when the pressure of the hydraulic fluid supplied to said hydraulic actuator is smaller than said first predetermined value, and pressure generating means for outputting a pilot pressure to said urging means, said pressure generating means including manually operating means capable of adjusting said pilot pressure to adjust said first predetermined value.

9. A hydraulic control system for construction machines according to claim 1, wherein said engine speed increasing means includes manually operating means capable of optionally adjusting a value of the pressure which initiates an increase in the rotational speed of said engine.

10. A hydraulic control system for construction machines according to claim 1, wherein said detecting means is a pressure sensor for converting the pressure of the hydraulic fluid, that is supplied to said hydraulic actuator, into an electric signal, and said engine speed increasing means includes processing means for controlling said engine control means in accordance with the pressure detected by said pressure sensor, and manually operating means for acting on said processing means to adjust a value of the pressure which initiates an increase in the rotational speed of said engine.

11. A hydraulic control system for construction machines according to claim 1, wherein said value of the pressure which initiates an increase in the rotational speed of said engine is substantially equal to said first predetermined value.

12. A hydraulic control system for construction machines according to claim 1, wherein said value of the pressure which initiates an increase in the rotational speed of said engine is slightly smaller than said first predetermined value.

13. A hydraulic control system for construction machines according to claim 1, wherein said detecting means comprises means for detecting the delivery pressure of said hydraulic pump as said pressure of the hydraulic fluid supplied to said hydraulic actuator.

14. A hydraulic control system for construction machines according to claim 1, wherein said detecting means comprises means for detecting the load pressure of said hydraulic actuator as said pressure of the hydraulic fluid supplied to said hydraulic actuator.

* * * * *